US012590503B2

(12) United States Patent
Pettibone

(10) Patent No.: US 12,590,503 B2
(45) Date of Patent: Mar. 31, 2026

(54) WELLBORE BALANCED PRESSURE COMPENSATION FOR ROTATING CONTROL DEVICE (RCD) ROTARY SEALS

(71) Applicant: Schlumberger Technology Corporation, Sugar Land, TX (US)

(72) Inventor: Nathaniel Pettibone, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/678,571

(22) Filed: May 30, 2024

(65) Prior Publication Data

US 2025/0369305 A1 Dec. 4, 2025

(51) Int. Cl.
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS

| | | | | |
|---|---|---|---|---|
| 5,178,215 | A | 1/1993 | Yenulis | |
| 6,227,547 | B1 | 5/2001 | Dietle | |
| 7,040,394 | B2 | 5/2006 | Bailey | |
| 7,258,171 | B2 | 8/2007 | Bourgoyne | |
| 7,743,823 | B2 | 6/2010 | Hughes et al. | |
| 7,798,496 | B2 | 9/2010 | Dietle | |
| 8,096,711 | B2 | 1/2012 | Beauchamp et al. | |
| 8,347,982 | B2 | 1/2013 | Hannegan | |
| 8,500,337 | B2 | 8/2013 | Beauchamp | |
| 9,284,811 | B2 | 3/2016 | Michaud | |
| 9,316,319 | B2 | 4/2016 | Dietle | |
| 9,567,817 | B2 | 2/2017 | Chambers | |
| 9,702,210 | B2 | 7/2017 | Dirksen | |
| 9,845,879 | B2 | 12/2017 | Dietle et al. | |
| 10,087,701 | B2 | 10/2018 | Bailey | |
| 10,240,426 | B2 | 3/2019 | Grace | |
| 10,267,117 | B2 | 4/2019 | Bailey | |
| 11,149,507 | B2 | 10/2021 | Tran | |
| 11,187,056 | B1 | 11/2021 | Tenorio | |
| 11,236,575 | B2 | 2/2022 | Dietrich | |
| 2011/0024195 | A1 | 2/2011 | Hoyer | |
| 2015/0315845 | A1* | 11/2015 | Chambers | E21B 33/03 166/82.1 |
| 2016/0168911 | A1 | 6/2016 | Karigan | |
| 2017/0159395 | A1* | 6/2017 | Grace | E21B 23/04 |
| 2019/0093445 | A1 | 3/2019 | Kulkarni | |
| 2019/0112890 | A1 | 4/2019 | Richie | |
| 2019/0234173 | A1 | 8/2019 | Bennett | |

* cited by examiner

*Primary Examiner* — Giovanna Wright
(74) *Attorney, Agent, or Firm* — Jeffrey D. Frantz

(57) ABSTRACT

A seal assembly of a rotating control device (RCD) includes an interior chamber isolated from an external portion of the RCD and configured to store compensation fluid. The seal assembly also includes a path coupled to the interior chamber. The seal assembly further includes a seal chamber coupled to the path. The seal assembly additionally includes a seal element disposed in the seal chamber and configured to form an annular seal about a tubular as the tubular rotates, moves axially, or both.

16 Claims, 4 Drawing Sheets

WELLBORE BALANCED PRESSURE COMPENSATION FOR ROTATING CONTROL DEVICE (RCD) ROTARY SEALS

BACKGROUND

The present disclosure generally relates to seals used in the production of natural resources.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

To meet consumer and industrial demand for natural resources, companies often invest significant amounts of time and money in searching for and extracting oil, natural gas, hydrocarbons, and other subterranean resources from the earth. Particularly, once a desired subterranean resource such as oil or natural gas is discovered, drilling and production systems are often employed to access and extract the resource. These systems may be located onshore or offshore depending on the location of a desired resource. Common methods include deploying the drilling and production systems on the surface or on a floating platform disposed above the discovered resources, and drilling a borehole into the surface of the earth to procure the desired resource(s).

In conjunction with these production systems and techniques, drilling fluid is injected into and circulated out of a wellbore. However, wellbore pressure differentials can cause issues with natural resource production.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

In certain embodiments, a seal assembly of a rotating control device (RCD), the seal assembly including an interior chamber isolated from an external portion of the RCD and configured to store compensation fluid; a path coupled to the interior chamber; a seal chamber coupled to the path; and a seal element disposed in the seal chamber and configured to form an annular seal about a tubular as the tubular rotates, moves axially, or both.

In certain embodiments, a seal assembly includes a movable piston; a housing at least partially surrounding the movable piston; an interior chamber isolated from an external portion of the seal assembly, wherein the movable piston is configured to move at least partially into and out of the interior chamber; a fluid path coupled to the interior chamber; a seal chamber coupled to the fluid path; and a seal element disposed in the seal chamber and configured to form an annular seal about a tubular as the tubular rotates, moves axially, or both.

In certain embodiments, a method includes receiving a wellbore fluid at a first face of a seal element configured to form an annular seal about a tubular as the tubular rotates, moves axially, or both; receiving a wellbore fluid at a first portion of a piston; moving the piston from a first position in an interior chamber of a seal assembly isolated from an external portion of the seal assembly to a second position in the interior chamber in response to a pressure of the wellbore fluid; and transmitting, via movement of the piston, a compensation fluid from the interior chamber to a second face of the seal.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness. These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
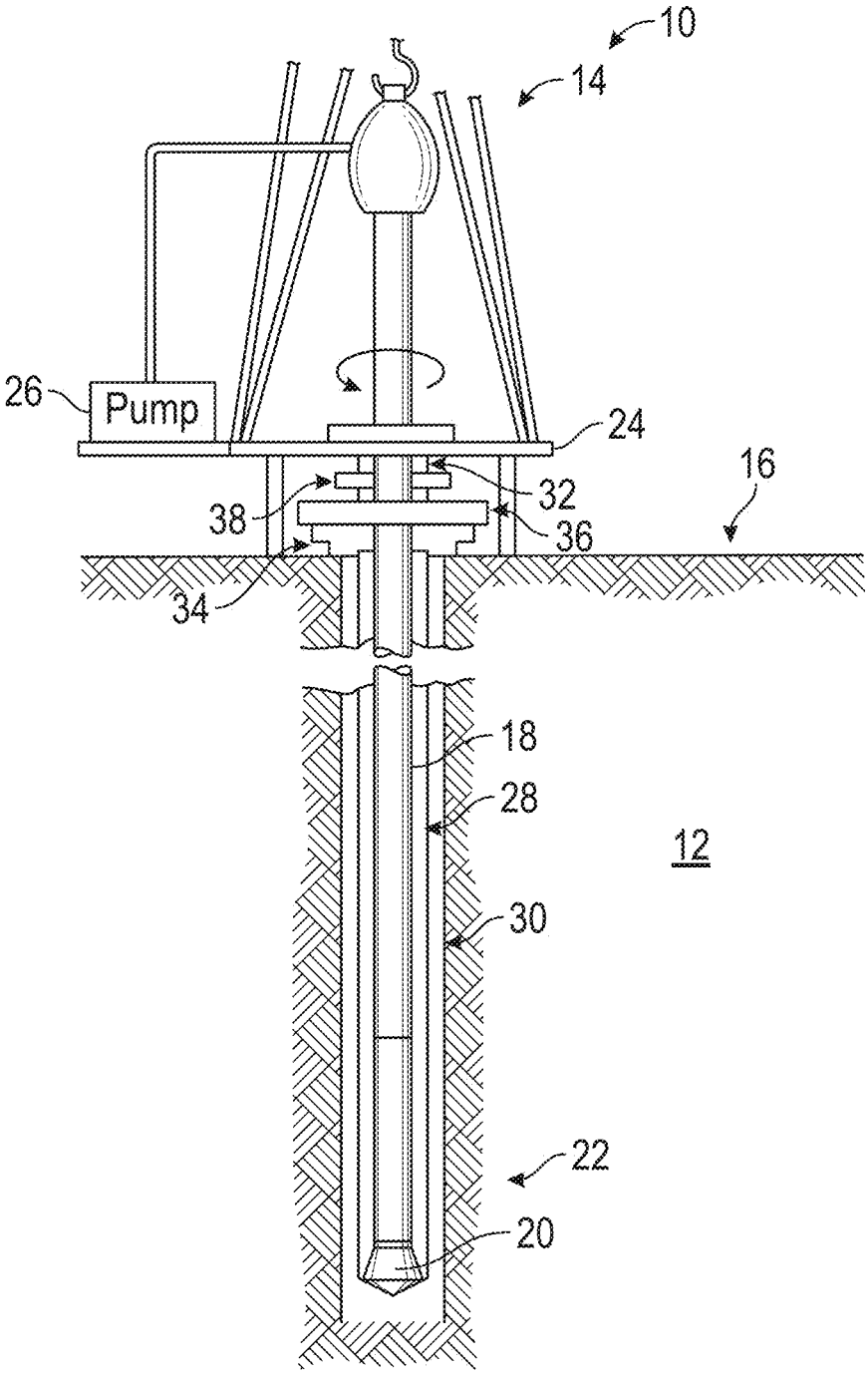
FIG. 1 is a schematic view of a drilling system, in accordance with aspects of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Certain terms are used throughout the description and claims to refer to particular features or components. As one skilled in the art will appreciate, different persons may refer to the same feature or component by different names. This document does not intend to distinguish between components or features that differ in name, but not function.

For decades, humans have relied on resources found below the earth's surface to meet increasing energy demands. These resources include but are not limited to natural gas, coal, hydrocarbons, petroleum, and other materials suitable to generate energy for consumption by humans. As energy demands increase, significant efforts are expended to extract an appropriate supply of energy to meet the increasing demand. Included in these efforts are systems and methods that enable expanded extraction of the resources, increase the efficiency of the extraction process, and technological advances that permit extraction and exploration in areas.

Drilling for natural resources can include injection of drilling fluid into a wellbore as a drill bit is in operation. This fluid may be returned to the surface, cleaned, and recirculated into the wellbore. One drilling operation and associated system that utilizes drilling fluid is a managed pressure drilling ("MPD") system whereby the pressure and flow of the drilling fluid is controlled.

Seal assemblies in general, and rotating control device (RCD) seal assemblies can be used in conjunction with MPD systems. RCD assemblies can be used to seal around rotating drill pipe during MPD operations. To achieve this, the RCD assembly can include an inner element, which seals on and rotates with the drill pipe. The RCD assembly can also include a static outer section, which houses the bearings and positions the RCD. There is an interface between the static and rotating components of the RCD, which must be sealed against wellbore pressure. This sealing is accomplished with rotary seals. However, at higher pressure differentials (e.g., wellbore pressure is greater than the pressure above the RCD), the rotary seals of the RCD can have performance issues, leading to leakage and/or wear of the seals (i.e., accelerating failures of the seals).

Present embodiments improve the performance of rotary seals of the RCD. For example, the seals may be pressure compensated by supplying a pressure to a backside of the rotary seals. This reduces the differential that must be sealed, improving the performance and life of the rotary seals. In some embodiments, the subassembly utilized to perform this pressure differential reduction is integral to the RCD. For example, embodiments include an interior chamber, which contains a volume of fluid and a floating piston which isolates the clean fluid from the wellbore. The fluid is ported to the backside of the rotary seal, which seals against wellbore pressure. As wellbore pressure is increased, the wellbore pressure pushes the piston into the fluid volume and increases the pressure to match. This pressure also transfers to the backside of the rotary seal and reduces the pressure differential across the seal to zero, allowing for improved performance of the rotary seal.

Turning to the drawings, FIG. 1 illustrates a drilling system 10 (e.g., subterranean drilling system) that may be used to drill a well through subterranean formations 12 to extract various fluids (e.g., oil, natural gas, or hydrocarbon containing fluids). In the illustrated embodiment, the drilling system 10 is an onshore drilling system (i.e., for land use). However, in other embodiments, the drilling system 10 can be an offshore drilling system (e.g., for subsea use). Additionally, the drilling system 10 may be utilized in conjunction with MPD operations. As illustrated, the drilling system 10 includes a drilling rig 14 at the surface 16. The drilling rig 14 may support and rotate a drill string 18, which includes a drill bit 20 at its lower end 22 to engage the subterranean formation 12.

The drilling system 10 can also include a platform 24, which can provide a physical location for portions of the drilling system 10, including the drilling rig 14, a pump 26 used in circulating fluid, e.g., drilling fluid, as well as other components, such as controllers, MPD hardware, and the like. In some embodiments, the pump 26 can transmit drilling fluid through the drill string 18 downwards to the lower end 22 of the drill string 18 (e.g., one or more drill pipes or tubulars). The drilling fluid, commonly referred to as "mud" or "drilling mud," may, for example, cool and/or lubricate the drill bit 20. At the drill bit 20, the drilling fluid may then exit the drill string 18 through ports (not shown) and flow into a wellbore 28 surrounded by casing 30. While drilling, the drilling fluid may be pushed toward the surface 16 through an annulus, for example, between the drill string 18 and the casing 30, thereby carrying drill cuttings away from the bottom of the wellbore 28. Once at the surface 16, the returned drilling fluid may be filtered and conveyed for reuse. Additionally, the drilling fluid may exert a mud pressure on the formation 12 to reduce likelihood of fluid from the formation 12 leaking, for example, to the surface 16.

As illustrated, the drill string 18 may pass through the platform 24 and may be disposed in a tubular member 32 (e.g., a drilling riser) that encircles the drill string 18. As additionally illustrated, the drilling system 10 can include a wellhead assembly 34. The wellhead assembly 34 can include or be coupled to components that allow for the control of conditions in the wellbore 28 and/or regulate activities therein. The wellhead assembly 34 can be coupled to the casing 30 and the wellhead assembly 34 can include or be coupled to components that allow for installation of the casing 30. Also illustrated is a blowout preventer (BOP) 36 that can operate to seal the wellbore 28 when issues arise.

The tubular member 32 can connect the BOP 36 and the platform 24. The tubular member 32 can also provide an annulus (e.g., between the drill string 18 and the tubular member 32) through which the drilling fluid may pass to be returned to the pump 26. The illustrated drilling system 10 also includes a rotating control device (RCD) 38 that operates to block fluid flow an annulus surrounding the drill string 18. For example, the RCD 38 may be configured to block the drilling fluid, cuttings, and/or other substances from passing from a region below the RCD 38 (i.e., lower end 22) to a region above the RCD 38 (e.g., the platform 24). While the RCD 38 is illustrated as being disposed between the BOP 36 and the platform 24, the RCD 38 can instead be disposed in other locations of the drilling system 10. For example, the RCD 38 can be disposed at or as part of the wellhead assembly 34, between the BOP 36 and the wellhead assembly 34, as part of the BOP 36, and/or in other similar regions of the drilling system 10. An embodiment of an RCD 38 is illustrated and discussed below with respect to FIGS. 2-4.

Figure 2:
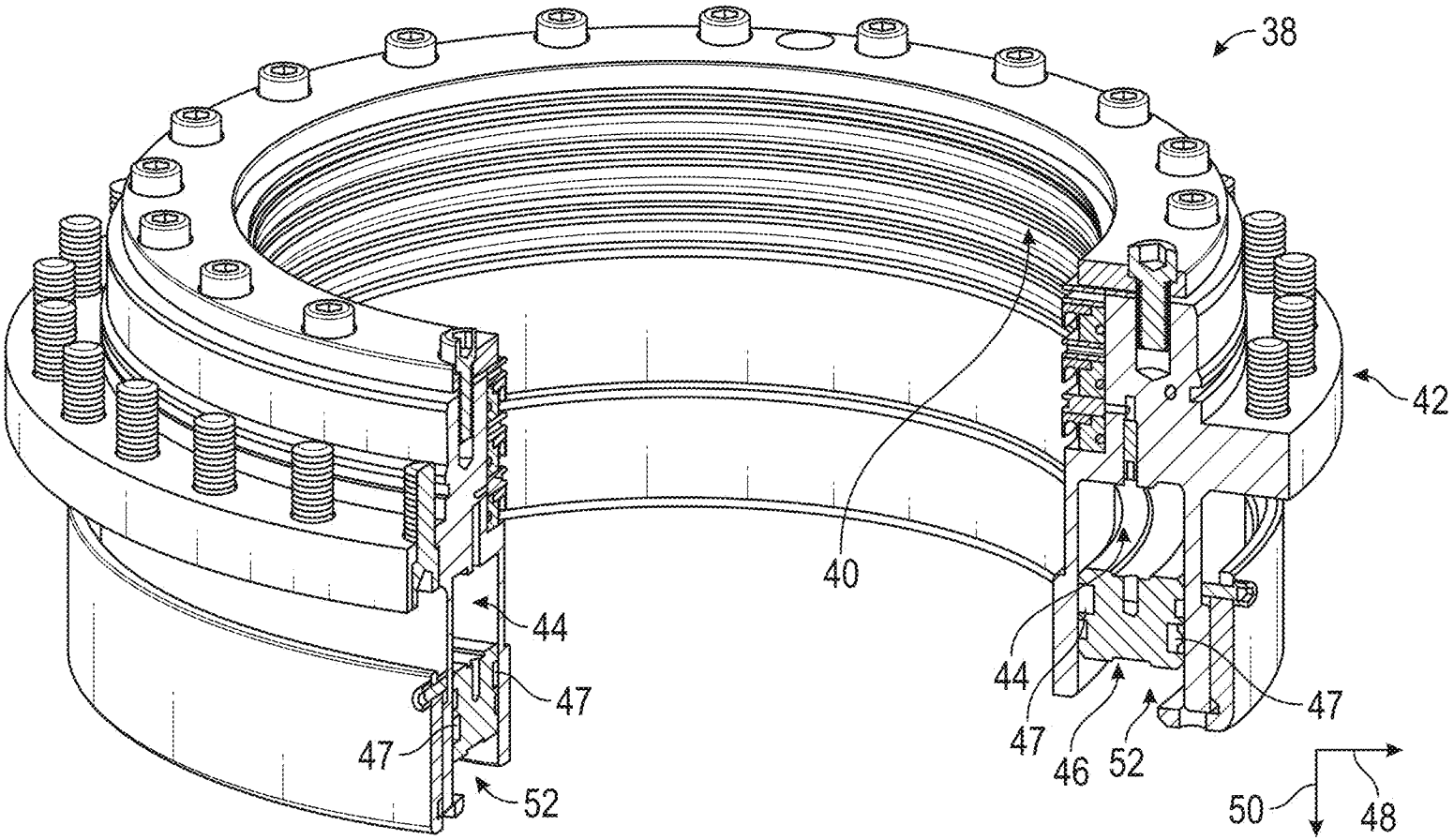
FIG. 2 is a cutaway perspective view of a portion of a seal assembly for the rotating control device (RCD) of FIG. 1, in accordance with aspects of the present disclosure.

FIG. 2 is a cutaway perspective view of the RCD 38. As noted above, the RCD 38 is primarily used in conjunction with managed pressure drilling ("MPD") operations, where a positive pressure is maintained on the wellbore 28 during drilling. The RCD 38 operates to seal around the drill string 18 and, for example, casing 30 or tubular member 32 to maintain a particular desired pressure while the drilling fluid is circulating. During drilling, there is rotation of the drill string 18 while the casing 30 or tubular member 32 remains fixed. The RCD 38 is a component that allows for sealing between the rotating component (i.e., the drill string 18) and the stationary component (i.e., the casing 30 or tubular member 32) through the use of rotary seals 40 as part of a seal assembly 42.

Thus, the seal assembly 42 is used to seal around an inner element (e.g., rotating shaft, rotating tubular, or rotatable tubular) of RCD 38, which seals on and rotates with the drill string 18 (e.g., to a drill pipe as a portion of the drill string 18). The interface between the static and rotating components of the RCD 38 is to be sealed against wellbore 28 pressure during MPD operations. To achieve this, the rotary seals 40 seals are utilized. However, as pressure differentials increase (e.g., a pressure of the wellbore 28 is greater than the pressure above the RCD 38, i.e., towards the platform 24), the rotary seals 40 can wear and/or leak.

One way to improve the performance is to pressure compensate the rotary seals 40 by supplying a pressure to the backside of one or more of the rotary seals 40 (i.e., the region away from the wellbore 28 fluids). This reduces the pressure differential above and below the RCD 38 that is to be sealed, which improves the performance and life of the rotary seals 40. One technique to provide pressure would be to include a pressure compensation system that utilizes external porting of the RCD 38 that is connected to a pump, which supplies differential pressure to the rotary seals 40. However, this system can include external hydraulic power units, sensors, hoses, etc. That is, externally supplied fluid to the RCD 38 typically includes costly additional external hardware, control logic, and a power source. Instead, present embodiments described herein allow for a self-contained sub-assembly (e.g., seal assembly 42) of the RCD 38 that operates to alleviate the aforementioned pressure differentials affecting the rotary seals 40 using no additional connections, hardware, pumps, controls, or power sources external to the RCD 38 for operation. The embodiments described herein provide an unpowered, passive, integrated sub-assembly (e.g., seal assembly 42) of the RCD 38 that can reduce system cost, setup time, and/or maintenance costs while providing for greater sealing by the rotary seals 40 and/or reduced wear.

As illustrated, the sub-assembly (e.g., seal assembly 42) of the RCD 38 is integral to the RCD 38. The seal assembly 42 includes an interior chamber 44 (e.g., whereby the interior chamber 44 is isolated from any external portion of the RCD 38) that can be filled with a volume of fluid (e.g., compensation fluid which can be water, oil, or another fluid). The seal assembly 42 also includes a piston 46 (e.g., a floating piston) that isolates the fluid in interior chamber 44 from the wellbore 28 and its wellbore 28 fluids. The piston 46 can be ring shaped, as illustrated in FIG. 2. The fluid in interior chamber 44 is ported (e.g., along a path located outwards in a radial direction 48 from the rotary seals 40, illustrated as extending away from the rotating drill string 18) to a backside of the rotary seals 40, which seal against the wellbore 28 pressure. The fluids in the wellbore 28 are in direct contact with the piston 46 via an aperture 52 in a bottom portion (e.g., located downwards in a longitudinal direction 50, illustrated as being directed towards lower end 22) of the seal assembly 42 that allows for the fluids in the wellbore 28 to directly interface with a bottom portion (e.g., located downwards the longitudinal direction 50) of the piston 46. Additionally, although the piston 46 can move upwards (in a direction opposite to longitudinal direction 50) and downwards (in the direction of longitudinal direction 50) due to the wellbore 28 pressure, the piston 46 fluidly seals the wellbore 28 fluids from the interior chamber 44 so that the fluid in the interior chamber 44 remains separated from the wellbore 28 fluids. For example, the piston 46 can include one or more seals 47 disposed about an external portion of the piston 46 and contacting walls of the interior chamber 44 (e.g., annular seals disposed about an outer radial portion of the piston 46 facing the stationary housing 54 and an inner radial portion of the piston 46 facing the rotating shaft 55).

As wellbore 28 pressure increases against the bottom portion of the piston 46, that pressure pushes the piston 46 upwards (in a direction opposite to the longitudinal direction 50) and into the interior chamber 44. This causes the fluid volume contained therein to port to the backside (i.e., above in an opposite direction to the longitudinal direction 50) of the rotary seals 40 with greater pressure. Indeed, the additional pressure provided to the backside of the rotary seals 40 matches the wellbore pressure until the pressure above (in the direction opposite to the longitudinal direction 50) the RCD 38 is equal to the pressure below (in the direction of longitudinal direction 50) the RCD 38. That is, the increased pressure transferred to the backside of the rotary seals 40 (i.e., above in the direction opposite to the longitudinal direction 50) reduces the pressure differential across the rotary seals 40 to zero, allowing for improved performance and/or longevity of the rotary seals 40.

Likewise, as wellbore 28 pressure decreases against the bottom portion of the piston 46, that pressure allows for the piston 46 to move downwards (in a direction of the longitudinal direction 50) and into the interior chamber 44. This causes the fluid volume contained therein to return back into the interior chamber 44, thus reducing the pressure provided to the backside of the rotary seals 40. The reduced pressure provided to the backside of the rotary seals 40 matches the wellbore pressure until the pressure above (in the direction opposite to the longitudinal direction 50) the RCD 38 is equal to the pressure below (in the direction of longitudinal direction 50) the RCD 38. That is, the decreased pressure transferred to the backside of the rotary seals 40 also operates to equalize the pressure differential across the rotary seals 40 to zero, allowing for improved performance and/or longevity of the rotary seals 40.

Figure 3:
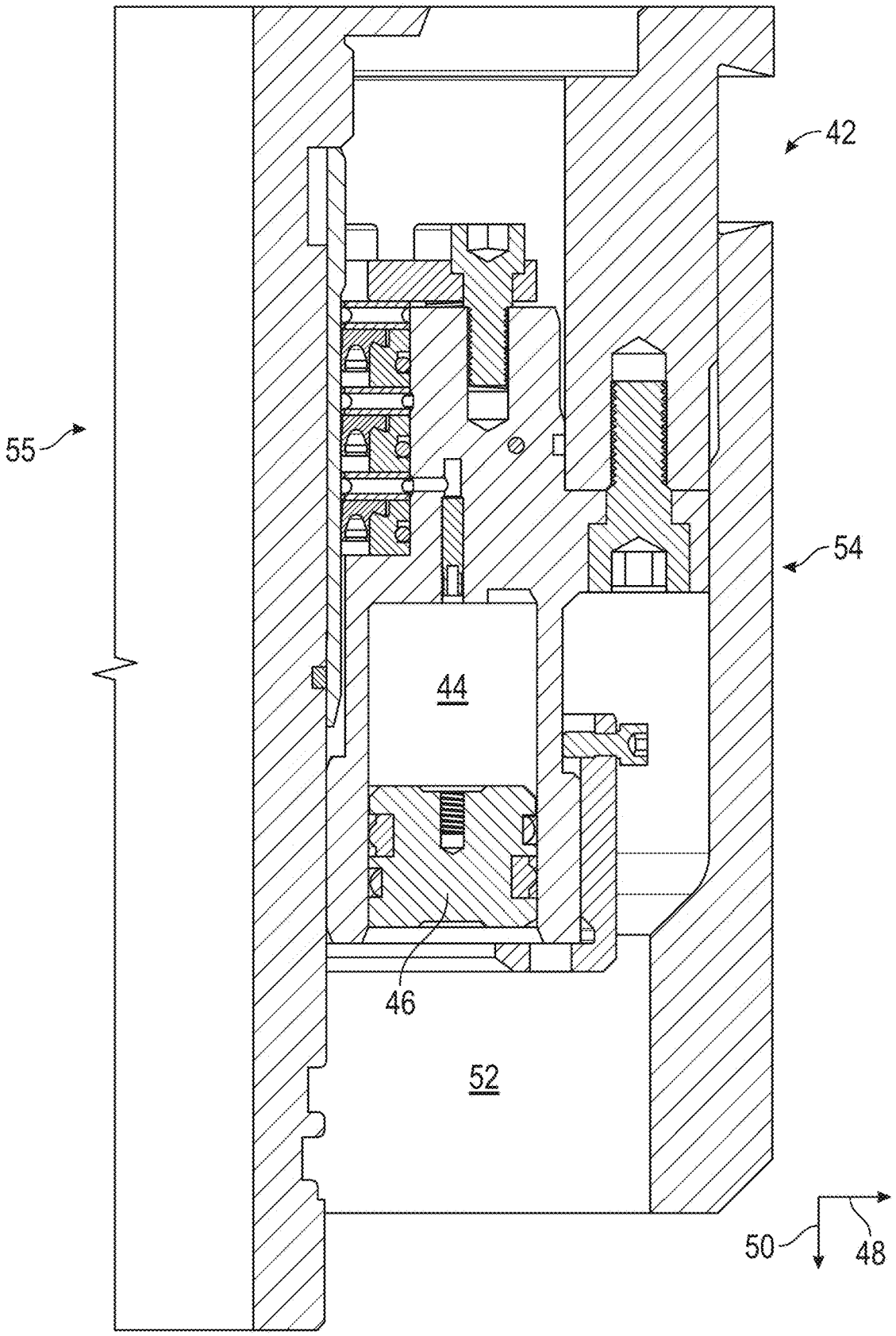
FIG. 3 is a schematic cross-sectional side view of the seal assembly of FIG. 2, in accordance with aspects of the present disclosure.

FIG. 3 is a schematic cross-sectional side view of the seal assembly 42. As illustrated, the seal assembly 42 is disposed between a rotating shaft 55 (e.g., a rotatable inner element, rotating tubular, or rotatable tubular) and a stationary housing 54 of the RCD 38. As illustrated, the wellbore 28 fluids contact the piston 46 via aperture 52. The piston 46 maintains a seal between the wellbore 28 fluids and the fluid (e.g., compensation fluid) disposed in interior chamber 44 (e.g., interior chamber). For example, the piston 46 may include one or more seals 47 disposed about an external portion of the piston 46 (e.g., annular seals disposed about an outer radial portion of the piston 46 facing the stationary housing 54 and facing the rotating shaft 55). As pressure of the wellbore 28 increases, it contacts a bottom portion (in the direction of longitudinal direction 50) of the piston 46. This causes the piston to move upwards (in a direction opposite to longitudinal direction 50) and into the interior chamber 44. This causes the fluid volume contained therein to port to the backside (i.e., above in an opposite direction to the longitudinal direction 50) of the rotary seals 40 with greater pressure. Indeed, the additional pressure provided to the backside of the rotary seals 40 matches the wellbore pressure until the pressure above (in the direction opposite to the longitudinal direction 50) the RCD 38 is equal to the pressure below (in the direction of longitudinal direction 50) the RCD 38.

Likewise, as wellbore 28 pressure decreases against the bottom portion of the piston 46, that pressure allows for the piston 46 to move downwards (in a direction of the longitudinal direction 50) and into the interior chamber 44. This causes the fluid volume contained therein to return back into the interior chamber 44, thus reducing the pressure provided to the backside of the rotary seals 40. The reduced pressure provided to the backside of the rotary seals 40 matches the wellbore pressure until the pressure above (in the direction opposite to the longitudinal direction 50) the RCD 38 is equal to the pressure below (in the direction of longitudinal direction 50) the RCD 38. That is, the decreased pressure transferred to the backside of the rotary seals 40 also operates to equalize the pressure differential across the rotary seals 40 to zero, allowing for improved performance and/or longevity of the rotary seals 40. This operation can be view with respect to FIG. 4.

Figure 4:
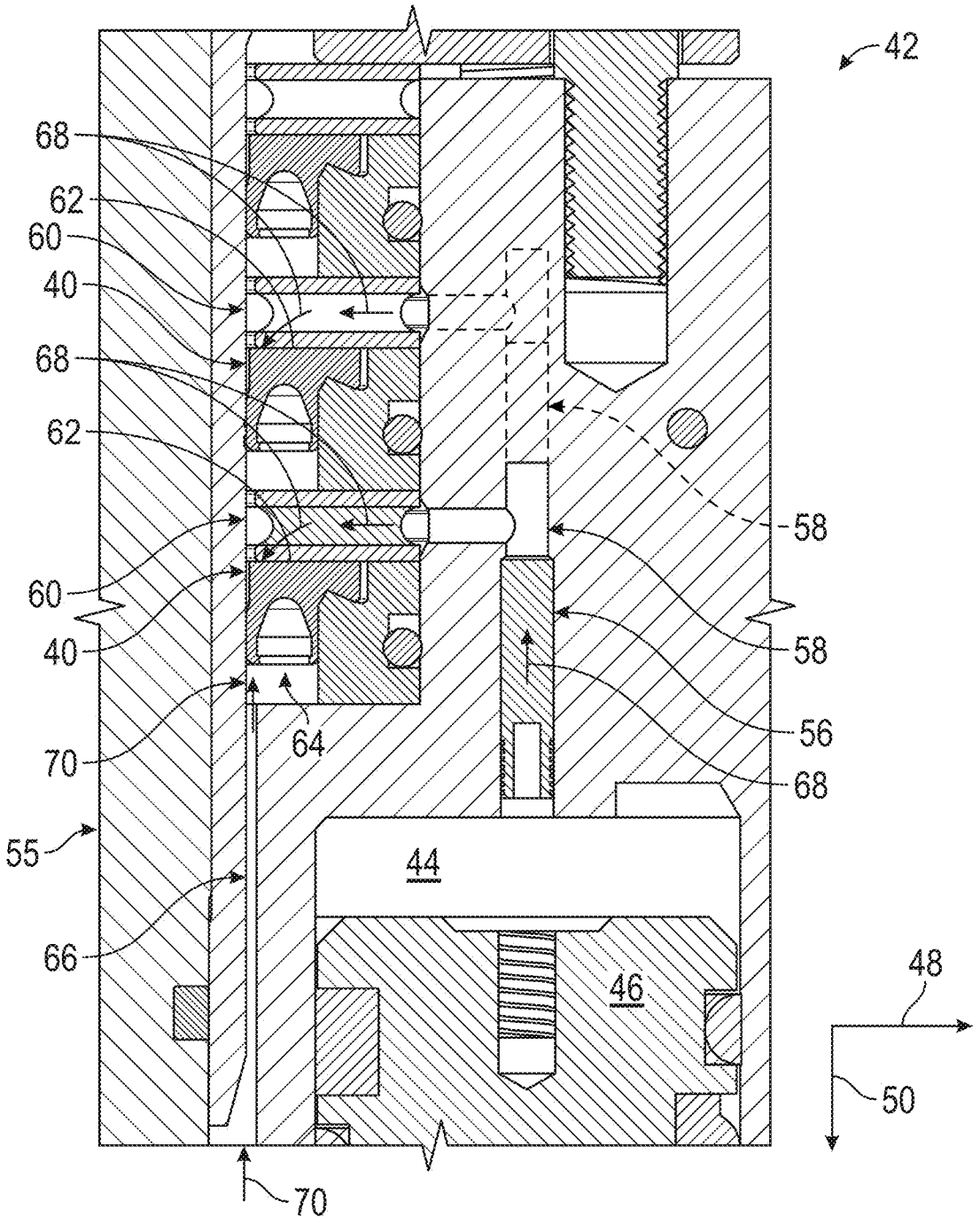
FIG. 4 is a schematic cross-sectional side view of the seal assembly of FIG. 2 when in operation, in accordance with aspects of the present disclosure.

FIG. 4 illustrates an enhanced schematic cross-sectional side view of the seal assembly of FIG. 2 when in operation. As illustrated, the piston 46 has had a pressure from wellbore 28 fluid contacting the piston 46. This causes the piston 46 to move upwards (i.e., in a direction opposite to longitudinal direction 50) into the interior chamber 44. This causes the fluid (e.g., compensation fluid) in interior chamber 44 to be displaced into path 56, where it is redirected by joint 58. As illustrated, joint 58 directs the fluid into seal chamber 60 whereby the fluid may exert pressure on a backside 62 of a rotary seal 40. In some embodiments, joint 58 may be a T-joint that can additionally connect to an additional seal chamber 60 to allow fluid to pressurize additional rotary seals 40 of the seal assembly 42.

As illustrated, the frontside 64 of the rotary seal 40 contacts wellbore 28 fluid. For example, wellbore 28 fluid can pass through path 66 and contact the frontside 64 of the rotary seal 40. This wellbore 28 fluid can also directly contact the piston 46 and cause it to extend into interior chamber 44, as illustrated in FIG. 4. This causes fluid from interior chamber 44 to be pushed into path 56, through joint 58, and into seal chamber 60, where the fluid interacts with the backside 62 of rotary seal 40. This flow is illustrated by directional arrows 68. Likewise, as noted above, wellbore 28 fluid can pass through path 66 and contact the frontside 64 of the rotary seal 40, as illustrated by directional arrows 68.

In this manner, the additional pressure provided to the backside of the rotary seals 40 (e.g., one or more rotary seals 40 in their respective seal chamber 60) matches the wellbore 28 pressure (e.g., at location 70) until the pressure above (in the direction opposite to the longitudinal direction 50) the RCD 38 is equal to the pressure below (in the direction of longitudinal direction 50) the RCD 38. That is, the increased pressure transferred to the backside of the rotary seals 40 (i.e., above in the direction opposite to the longitudinal direction 50) reduces the pressure differential across the rotary seals 40 to zero, allowing for improved performance and/or longevity of the rotary seals 40.

The subject matter described in detail above may be defined by one or more clauses or embodiments, as set forth below.

In certain embodiments, a seal assembly of a rotating control device (RCD), the seal assembly comprising an interior chamber isolated from an external portion of the RCD and configured to store compensation fluid; a path coupled to the interior chamber; a seal chamber coupled to the path; and a seal element disposed in the seal chamber and configured to form an annular seal about a tubular as the tubular rotates, moves axially, or both.

The seal assembly of the preceding embodiment, wherein the seal element comprises a frontside configured to directly contact a wellbore fluid.

The seal assembly of any preceding embodiment, wherein the seal element comprises a backside configured to directly contact the compensation fluid.

The seal assembly of any preceding embodiment, wherein the seal element is configured to receive the compensation fluid having a first pressure equivalent to a second pressure of the wellbore fluid.

The seal assembly of any preceding embodiment, comprising a second seal chamber coupled to the path.

The seal assembly of any preceding embodiment, comprising a second seal element disposed in the second seal chamber and configured to form an annular seal about a tubular as the tubular rotates, moves axially, or both.

The seal assembly of any preceding embodiment, wherein the second seal element comprises a frontside configured to directly contact a wellbore fluid.

The seal assembly of any preceding embodiment, wherein the second seal element comprises a backside configured to directly contact the compensation fluid.

The seal assembly of any preceding embodiment, wherein the second seal element is configured to receive the compensation fluid having a first pressure equivalent to a second pressure of the wellbore fluid.

The seal assembly of any preceding embodiment, comprising a piston at least partially disposed in the interior chamber.

The seal assembly of any preceding embodiment, wherein the piston comprises at least a first portion configured to directly contact the compensation fluid.

The seal assembly of any preceding embodiment, wherein the piston comprises at least a second portion configured to directly contact a wellbore fluid.

The seal assembly of any preceding embodiment, wherein the piston comprises an annular ring.

The seal assembly of any preceding embodiment, comprising an annular seal disposed about an outer portion of the piston, wherein the annular seal is configured to prevent a wellbore fluid from entering the interior chamber.

A seal assembly, comprising: a movable piston; a housing at least partially surrounding the movable piston; an interior chamber isolated from an external portion of the seal assembly, wherein the movable piston is configured to move at least partially into and out of the interior chamber; a fluid path coupled to the interior chamber; a seal chamber coupled to the fluid path; and a seal element disposed in the seal chamber and configured to form an annular seal about a tubular as the tubular rotates, moves axially, or both.

The seal assembly of the preceding embodiment, comprising a compensation fluid disposed in the one or more of the interior chamber, the fluid path, and the seal chamber.

The seal assembly of any preceding embodiment, wherein the seal element comprises a first side configured to interface with the compensation fluid and a second side opposite of the first side, wherein the second side is configured to interface with a second fluid.

A method, comprising: receiving a wellbore fluid at a first face of a seal element configured to form an annular seal about a tubular as the tubular rotates, moves axially, or both; receiving a wellbore fluid at a first portion of a piston; moving the piston from a first position in an interior chamber of a seal assembly isolated from an external portion of the seal assembly to a second position in the interior chamber in response to a pressure of the wellbore fluid; and transmitting, via movement of the piston, a compensation fluid from the interior chamber to a second face of the seal.

The method of the preceding embodiment, wherein the transmitting the compensation fluid from the interior chamber to the second face of the seal element changes a pressure of the compensation fluid from a first value to a second value.

The method of any preceding embodiment, wherein the second value of the pressure of the compensation fluid is equivalent to the pressure of the wellbore fluid.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform] ing [a function] . . . " or "step for [perform] ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A seal assembly of a rotating control device (RCD), the seal assembly comprising:

a piston comprising an annular ring;

a housing at least partially surrounding the piston wherein the housing comprises a lip as a support structure to maintain the piston as being disposed in the housing;

an interior chamber of the housing, wherein the interior chamber is isolated from an external portion of the RCD and configured to store compensation fluid;

a path coupled to the interior chamber;

a seal chamber coupled to the path; and a seal element disposed in the seal chamber and configured to form an annular seal about a tubular as the tubular rotates, moves axially, or both, wherein the seal element is configured to receive the compensation fluid having a first pressure equivalent to a second pressure of a wellbore fluid so that a pressure differential across the seal element during operation is zero.

2. The seal assembly of claim 1, wherein the seal element comprises a frontside configured to directly contact the wellbore fluid.

3. The seal assembly of claim 2, wherein the seal element comprises a backside configured to directly contact the compensation fluid.

4. The seal assembly of claim 1, comprising a second seal chamber coupled to the path.

5. The seal assembly of claim 4, comprising a second seal element disposed in the second seal chamber and configured to form a second annular seal about the tubular as the tubular rotates, moves axially, or both.

6. The seal assembly of claim 5, wherein the second seal element comprises a frontside configured to directly contact the wellbore fluid.

7. The seal assembly of claim 6, wherein the second seal element comprises a backside configured to directly contact the compensation fluid.

8. The seal assembly of claim 7, wherein the second seal element is configured to receive the compensation fluid having a first pressure equivalent to a second pressure of the wellbore fluid.

9. The seal assembly of claim 1, wherein the piston comprises at least a first portion configured to directly contact the compensation fluid.

10. The seal assembly of claim 9, wherein the piston comprises at least a second portion configured to directly contact the wellbore fluid.

11. The seal assembly of claim 1, comprising a second annular seal disposed about an outer portion of the piston, wherein the second annular seal is configured to prevent a wellbore fluid from entering the interior chamber.

12. A seal assembly, comprising:

a movable piston;

a housing at least partially surrounding the movable piston, wherein the housing comprises a lip as a support structure to maintain the movable piston as being disposed in the housing;

an interior chamber disposed in the housing, wherein the interior chamber is isolated from an external portion of the seal assembly, wherein the movable piston is configured to move at least partially into and out of the interior chamber;

a fluid path coupled to the interior chamber;

a first seal chamber coupled to the fluid path;

a first seal element disposed in the first seal chamber and configured to form an annular seal about a tubular as the tubular rotates, moves axially, or both, wherein the first seal element is configured to receive compensation fluid having a first pressure equivalent to a second pressure of a wellbore fluid so that a pressure differential across the first seal element during operation is zero;

a second seal chamber coupled to the fluid path; and a second seal element disposed in the second seal chamber and configured to form a second annular seal about the tubular as the tubular rotates, moves axially, or both, wherein the second seal element comprises a frontside configured to directly contact the wellbore fluid.

13. The seal assembly of claim 12, comprising the compensation fluid disposed in the one or more of the interior chamber, the fluid path, and the first seal chamber.

14. The seal assembly of claim 13, wherein the first seal element comprises a first side configured to interface with the compensation fluid and a second side opposite of the first side, wherein the second side is configured to interface with a second fluid.

15. A method, comprising:

receiving a wellbore fluid at a first face of a seal element configured to form an annular seal about a tubular as the tubular rotates, moves axially, or both;

receiving the wellbore fluid at a first portion of a movable piston comprising an annular ring;

moving the movable piston from a first position in an interior chamber of a housing of a seal assembly isolated from an external portion of the seal assembly to a second position in the interior chamber in response to a pressure of the wellbore fluid, wherein the housing comprises a lip as a support structure to maintain the movable piston as being disposed in the housing; and transmitting, via movement of the movable piston, a compensation fluid from the interior chamber to a second face of the seal element, wherein the seal element is configured to receive the compensation fluid having a first pressure equivalent to a second pressure of the wellbore fluid so that a pressure differential across the seal element during operation is zero.

16. The method of claim 15, wherein the transmitting the compensation fluid from the interior chamber to the second face of the seal element changes a pressure of the compensation fluid from a first value to a second value.

* * * * *